United States Patent [19]

Kelly et al.

[11] Patent Number: 4,703,962

[45] Date of Patent: Nov. 3, 1987

[54] MAGNETIC DOOR LOCK WITH TIME DELAY OPTION

[75] Inventors: Michael A. Kelly, Felton; Bruce G. Beigel, Seven Valleys, both of Pa.; Emmanuel L. Logan, Jr., Columbia, Md.

[73] Assignee: Reliable Security Systems, Inc., Cockeysville, Md.

[21] Appl. No.: 860,926

[22] Filed: May 8, 1986

Related U.S. Application Data

[63] Continuation-in-part of Ser. No. 700,867, Feb. 12, 1985, Pat. No. 4,652,028.

[51] Int. Cl.[4] ..... E05C 17/56

[52] U.S. Cl. ..... 292/251.5; 292/DIG. 65

[58] Field of Search ..... 292/251.5, 92, 201, 292/144, DIG. 65

[56] References Cited

U.S. PATENT DOCUMENTS

| | | | |
|---|---|---|---|
| 3,204,154 | 8/1965 | Crandell | 292/251.5 X |
| 3,426,166 | 2/1969 | Cancejll | 292/251.5 X |
| 3,438,051 | 4/1969 | DeVines | 70/434 X |
| 4,257,631 | 3/1981 | Logan, Jr. | 292/251.5 |
| 4,287,512 | 9/1981 | Combs . | |
| 4,314,722 | 2/1982 | Logan, Jr. . | |
| 4,324,425 | 4/1982 | Logan . | |
| 4,328,985 | 5/1982 | Logan . | |
| 4,351,552 | 9/1982 | VanDerLinden . | |
| 4,354,699 | 10/1982 | Logan . | |
| 4,470,625 | 9/1984 | Walsh et al. . | |
| 4,487,439 | 12/1984 | McFadden | 292/251.5 |
| 4,516,114 | 5/1985 | Cook . | |
| 4,540,208 | 10/1985 | Logan, Jr. et al. . | |
| 4,609,910 | 9/1986 | Geringer et al. . | |

*Primary Examiner*—Richard E. Moore

*Attorney, Agent, or Firm*—Millen & White

[57] ABSTRACT

A magnetic door lock with a time delay option includes an electromagnet mounted on a door frame and an armature mounted on a door. The electromagnet has a pair of laterally spaced slots therein which each have a reed switch therein for monitoring magnetic flux in the electromagnet. When the armature is engaged with the electromagnet, the magnetic flux is at a selected level sufficient to close the reed switches. If, due to tampering or some other reason, the magnetic flux drop does not reach the selected level, at least one of the reed switches will remain open indicating that the armature is not securely engaged with the electromagnet. The door lock also includes separate mounting plates for mounting the electromagnet and armature so that the electromagnet and armature will be properly aligned when mounted. A plunger is provided adjacent the electromagnet for engagement by a block adjacent the armature. When an attempt is made to open the door, the plunger moves thereby sensing the attempt. The plunger negates the need for an electric hinge for carrying current across the gap between the door and door jamb.

8 Claims, 8 Drawing Figures

MAGNETIC DOOR LOCK WITH TIME DELAY OPTION

CO-PENDING APPLICATION

This application is a continuation-in-part application of U.S. application Ser. No. 700,867, filed Feb. 12, 1985, now U.S. Pat. No. 4,652,028, issued Mar. 24, 1987.

RELATED UNITED STATES PATENTS

"Emergency Exit Door Latching and Locking Apparatus", Ser. No. 22,110, filed Mar. 3, 1979, now U.S. Pat. No. 4,351,552.

"Point of Egress Control Device for Securing Exit Door Safely", Ser. No. 929,968, filed Aug. 1, 1978, now U.S. Pat. No. 4,324,425.

"Magnetic Emergency Exit Door Lock with Delayed Opening", Ser. No. 051,724, filed June 25, 1979, now U.S. Pat. No. 4,257,631.

"Timing Delay for Emergency Exit Door", Ser. No. 125,995, filed Feb. 29, 1980, now U.S. Pat. No. 4,328,985.

"Timing Apparatus for Delaying Opening of Doors", Ser. No. 089,398, filed Aug. 10, 1979, now U.S. Pat. No. 4,314,722.

"Point-of-Egress Control Device Safely Securing Emergency Exit Doors", Ser. No. 148,403, filed May 9, 1980, now U.S. Pat. No. 4,354,699.

"Emergency Exit Door Latch with Hydraulic and Electronic Delay", Ser. No. 263,955, filed May 15, 1981, now U.S. Pat. No. 4,470,625.

"Point-of-Egress Control Device for Safely Securing Emergency Exit Doors", Ser. No. 423,523, filed Sept. 27, 1982, now U.S. Pat. No. 4,540,208.

BACKGROUND OF THE INVENTION

1. Field of the Invention

The instant invention relates to magnetic locks. More particularly, the instant invention relates to emergency exit door security systems wherein the system includes a magnetic door lock which senses when an attempt is made to open the door and/or senses when the lock is not secure.

2. Technical Considerations and Prior Art

The numerous patents listed above as "Related Patents" are generally directed to devices for delaying opening of emergency exit doors to prevent unauthorized exit from a building or room. Of particular interest with respect to the instant invention is U.S. Pat. No. 4,257,631, "Magnetic Emergency Exit Door Lock with Delayed Opening". As is readily apparent from the disclosure of this patent, initiation of a delayed time, opening interval is effected by pushing on the panic bar of the emergency exit door. The panic bar depresses a plunger of a switch, which switch in return is connected to time delay circuitry. Since the time delay circuitry is not disposed on the door, the line connecting the time delay circuitry to the switch must "jump the gap" between the hinged edge of the door and the door frame. In order to solve this problem, an "electric hinge" is utilized, which hinge has conductors and/or connectors therein for carrying current across the gap. These hinges are very expensive and are frequently difficult to select. This is because it is preferable that an electric hinge match the hinge set which a door is designed to accept. Frequently, a matching electric hinge is not available. In order to connect the switch to the time delay circuitry, a wire is usually run through the interior of the door to the electric hinge. Thereafter, the wire is run from the door jam side of the hinge through the door jam or wall to the circuitry. Running these wires is a time consuming, expensive operation.

In addition to the economic considerations, there are mechanical and safety considerations. There are numerous types of panic bars now on the market with which the switch must be mated. Accordingly, it is frequently difficult to configure the design and location of the switch so that it will operate with the particular panic hardware under consideration. Moreover, in many installations, the switch is exposed and therefore subject to damage and vandalism. Consequently, the switch may not operate properly when there is a need to open the emergency exit.

The assignee of the inventors named in the instant application has found that there is a market for magnetic locks both with the time delay feature and without the time delay feature. This is because it is frequently necessary, for one reason or another, to provide an indication that someone is attempting to open an emergency exit door. This indication may be used to start a time delay count in accordance with the principles disclosed and claimed in the aforelisted "Related Patents" or may simply be used to trip an alarm. For whatever reason, existing door security systems utilizing magnetic locks need a convenient, reliable and inexpensive way to provide such indication.

The prior art includes U.S. Pat. Nos. 4,487,439; 4,516,114 and 4,287,512 which address at least some of the concerns with which the instant invention deals. U.S. Pat. No. 4,487,439 discloses an electromagnetic lock with a floating armature which automatically adjusts for misalignments between the electromagnet and armature. However, there is no provision in this patent for sensing an attempt to open the door with which the lock is used, nor is there any provision for detecting whether or not the door is secure. Both U.S. Pat. Nos. 4,516,114 and 4,297,512, disclose provisions for sensing if a door equipped with an electromagnetic lock is secure. However, neither patent discloses a provision for detecting an attempt to open a door, which detection is necessary if a delayed opening arrangement is to be utilized. In U.S. Pat. No. 4,516,114, the current between two portions of the electromagnet is monitored to determine if the armature is in contact therewith. However, in this patent the security of the electromagnetic lock may be compromised by a sheet of aluminum foil. In U.S. Pat. No. 4,287,512 Hall cells are used to monitor magnetic flux in the electromagnet lock to determine if there has been or is an attempt to defeat the lock by taping or applying an external counter-magnetic field. However, with this arrangement there is no provision for detecting reduction of magnetic holding force due to skewing of the armature with respect to the electromagnet. Moreover, there is no suggestion in this patent of a provision for coordinating the operation of two types of sensors used with magnetic locks.

SUMMARY OF THE INVENTION

In view of the deficiencies of the prior art, it is a feature of the instant invention to provide new and improved apparatus for indicating that an attempt is being made to open a door equipped with a magnetic lock; that an attempt has been made to defeat the magnetic lock, and/or that the magnetic lock for some reason is not secure.

In order to accomplish these feature, the instant invention contemplates a door locking arrangement wherein an armature is mounted on a door and an electromagnet is mounted on an adjacent door jam. A switch is mounted on the door jam and a switch operator on the door for operating the switch in response to movement of the door. The switch is associated with a circuit which indicates the following conditions:

1. the door is closed; and
2. an attempt is being made to move the door from a closed position to an open position.

In accordance with a preferred embodiment, the switch is mounted in proximity with the electromagnet and the switch operator in proximity to the armature.

The instant invention further contemplates reed switches, juxtaposed with the electromagnet, which reed switches change mode when the armature is properly in contact with the electromagnet to indicate that the armature is being held by the electromagnet.

In order to assure proper contact between the armature and electromagnet, the armature is mounted loosely on the door so that it will float with respect thereto. This compensates for misalignment between the armature and electromagnet due to errors either in mounting the electromagnet or in the plumb of the door so as to allow door movement to trigger the time delay current.

In order to minimize misalignment of the door, both the electromagnet and armature are mounted on previously secured mounting plates.

BRIEF DESCRIPTION OF THE DRAWINGS

Various other objects, features and attendant advantages of the present invention will be more fully appreciated as the same becomes better understood when considered in connection with the accompanying drawings, in which like reference characters designate the same or similar parts throughout the several views, and wherein:

FIG. 8 is a perspective view of a template used to position mounting plateds for the armature and electromagnet of the lock assembly.

DESCRIPTION OF THE PREFERRED EMBODIMENT

Figure 1:
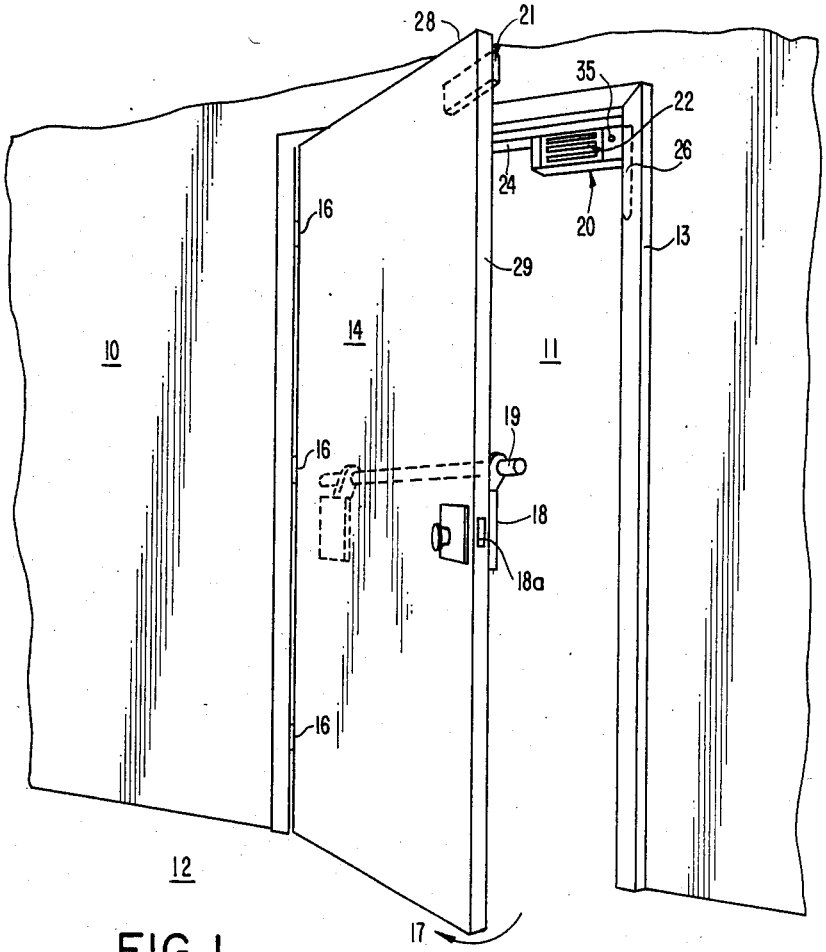
FIG. 1 is a perspective view of an electromagnetic lock according to the instant invention, installed in a door jam for locking a door.
Figure 2:
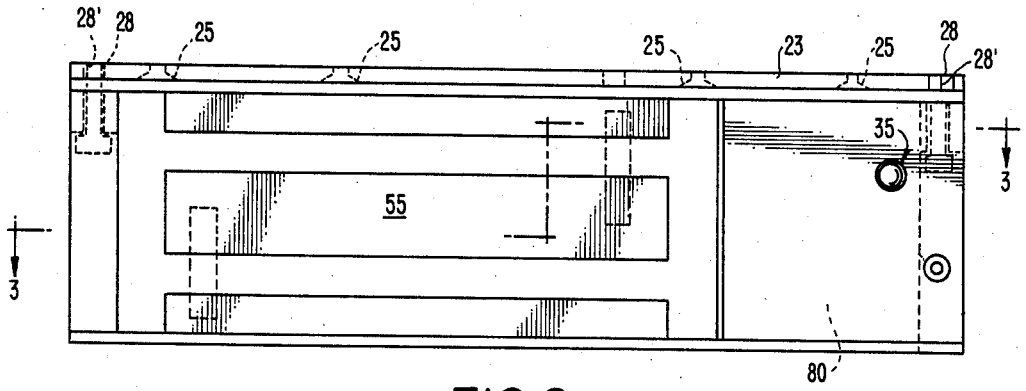
FIG. 2 is a front view of the electromagnet lock assembly which is mounted on the door jamb of FIG. 1.

Referring now to FIG. 1, there is shown a wall 10 which is used to separate an interior space 11 from an exterior space 12. The wall has a door frame 13 mounted therein in which a door 14 is mounted to swing about hinges from a closed position to an open position in the direction of arrow 17.

In the illustrated embodiment, the door 14 is equipped with standard panic lock hardware 18 including a panic bar 19. Normally, upon pressing the panic bar 19, the panic lock hardware 18 undogs or retracts a bolt 18*a* allowing the door 14 to swing open in the direction of the arrow 17.

In accordance with the instant invention, opening of the door 14 is further controlled by a magnetic lock, designated generally by the numeral 20, which lock includes an armature, designated generally by the numeral 21, and an electromagnet assembly designated generally by the numeral 22. The electromagnet assembly 22 is mounted on the door frame 13 in an upper corner, preferably beneath and behind a top door jam 24 and inside and behind a side door jam 26. The armature 21 is preferably mounted on the door 14 adjacent the top edge 28 of the door and the free edge 29 of the door. When the door 14 is closed and the electromagnet 22 assembly is energized, the armature 21 is held by the electromagnet 22 with approximately 1200 pounds of force so that the door 14 cannot be forced open by a person inside the enclosure 11. There are several other companies producing locks having an electromagnet assembly 22 and an armature 21 suitable to supply the holding force necessary to secure the door 14 of the instant invention in a closed position.

In accordance with the features of the instant invention, the electromagnet assembly 22 is equipped with a switch, designated generally by the numeral 35, which switch may be conveniently positioned adjacent to the electromagnet assembly 22. As will be further explained hereinafter, the armature 21 has structure thereon for engaging and operating the switch 35. Consequently, the switch 35 is used to sense if there is an attempt to open the door.

Figure 3:
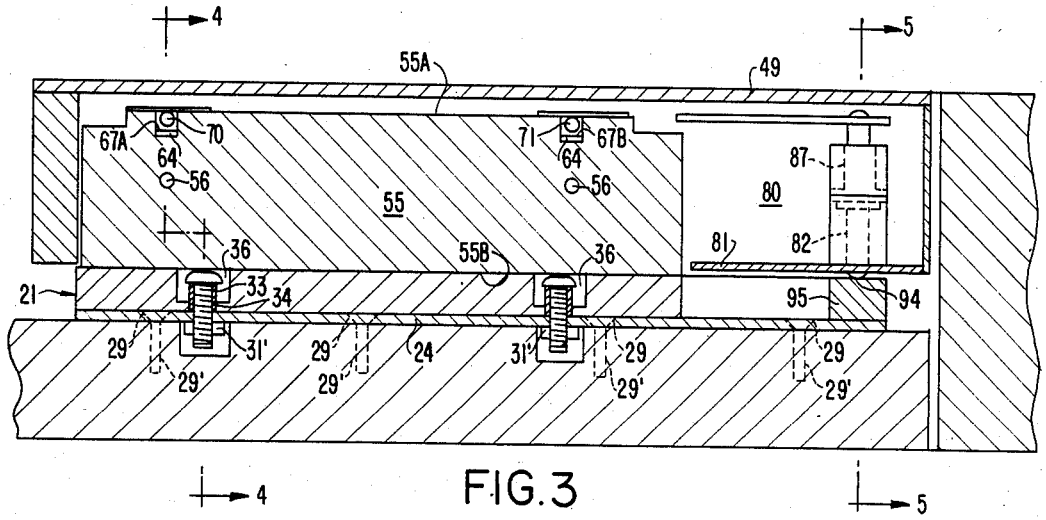
FIG. 3 is a cross-section of the electromagnet lock assembly taken along lines 3—3 of FIG. 2.
Figure 4:
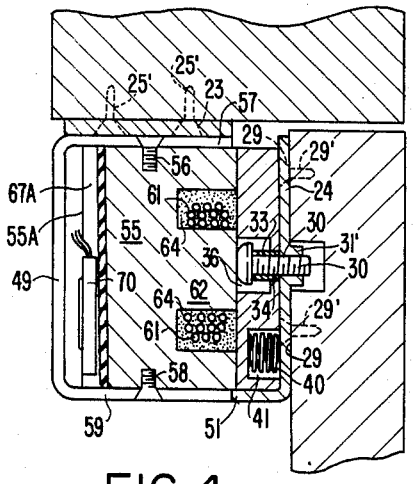
FIG. 4 is a cross-section of the electromagnet lock assembly taken along lines 4—4 of FIG. 3.
Figure 5:
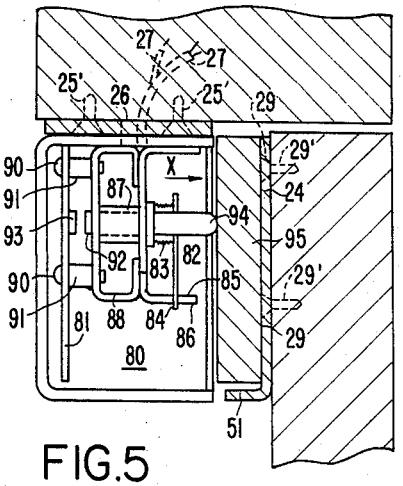
FIG. 5 is a cross-section of the electromagnet lock assembly taken along lines 5—5 of FIG. 3.
Figure 6:
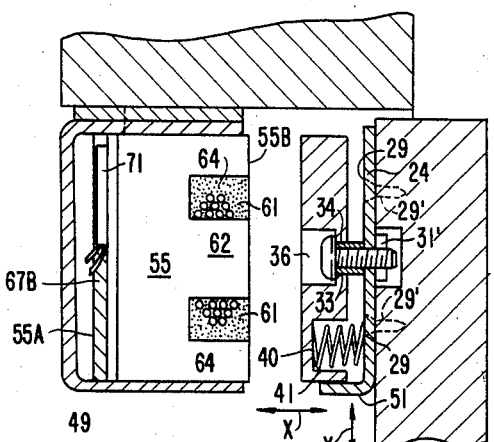
FIG. 6 is a cross-section of the electromagnet lock assembly taken along lines 6—6 of FIG. 3.

Referring now to FIGS. 2–6, in order to conveniently mount the electromagnet assembly 22 to the door jam 13 and the armature 21 to the door 14, a mounting plate 23 is provided for the electromagnetic assembly 22 and a mounting plate 24 is provided for the armature 21. The plate 23 has a plurality of counter-sunk holes 25 therein, perhaps eight in number, each of which receives a mounting screw for securing the mounting plate 23 to the door jam 13 with, for example, self-tapping screws 25' if the door jam 13 is metal. As is seen in FIGS. 5 and 6, the mounting plate 23 also has a bore 26 therethrough, through which pass electrical leads 27 used for energizing the magnetic assembly 22 and for monitoring control circuitry associated therewith. The mounting plate 23 also has a pair of threaded bores 28 which receive machine screws 28' (see FIG. 2) in order to secure the electromagnetic assembly 22 to the plate 23 after the plate has been mounted on the door jam 13.

The mounting plate 24 for mounting the armature 21 has a plurality of counter-sunk screw holes 29 therethrough which receive mounting screws 29' that secure the mounting plate 24 to the door 14. The mounting plates 23 and 24 are secured to the door jam 13 and the door 14, respectively by marking the screw holes in the door jam and door with a template when the door is closed. With magnetic locks, it is very important that the electromagnetic assembly 22 and armature 21 be properly aligned. It is much easier to properly align plate-type mounting members than to attempt to properly align operational components, such as the electromagnetic assembly 22 and the armature 21. Since the mounting plates 23 and 24 have fixed screw holes 28 and 30 for mounting the electromagnetic assembly 22 and armature 21 respectively, proper positioning of the electromagnet and armature can be accomplished by simply properly positioning the mounting plates. A well known and widely practiced approach to mounting one member on another is to use a template for correctly positioning screw holes. Such a conventional template is shown in FIG. 8 with holes 25 which identify the proper location for screw holes.

The electromagnet assembly 22 is rigidly secured to the mounting plate 23 by the bolts 28'. However, as seen in FIG. 4, the armature 21 is permitted to float in the "X" direction with respect to the mounting plate 24. This is accomplished by configuring the bolts 30' substantially as shoulder bolts wherein sleeves 33 surround the bolts 30' and received in round holes 34 in the armature 21. The heads 35 of the bolts rest within bores 36 in the armature 21. Preferably, the bolts 30' have nuts 31' into which they are threaded when mounting the armature 21 on the mounting plate 24. Preferably, a pair of coil springs 40 (only one of which is shown) are received in bores 41 in the armature 21 to keep the armature 21 projected toward the electromagnet assembly 22.

Referring now further to FIGS. 2–6, wherein the specific details of the electromagnetic lock 20 are set forth, it is seen that the components of the electromagnetic assembly 22 are contained within an aluminum housing 49 while the armature 21 is shielded along its lower edge by a flange 51 which is integral with the mounting plate 24. Consequently, all working parts of the electromagnetic lock assembly 20 are enclosed so as to minimize the chances of damage and to discourage tampering. The electromagnetic assembly 22 includes an electromagnet 55 which is held within the housing 49 by a pair of machine screws 56 through the top flange 57 of the housing and a pair of screws 58 through the bottom flange 59 of the housing. Preferably, the electromagnet 55 is comprised of a multiplicity of "E"-shaped laminations held in abuttment with one another in accordance with conventional procedures. In accordance with a conventional arrangement, a coil 61 surrounds the middle leg 62 of the electromagnet 55 and is embedded in potting material 64. The coil 61 has leads 62 extending therefrom which are connected to the circuitry of FIG. 7, as will be further explained hereinafter.

In accordance with the instant invention, the core of the electromagnet 55 has a pair of slots 67A and 67B therein which are laterally spaced from one another. The slots 67A and 67B are generally perpendicular to the upper and lower surfaces of the core of the electromagnet 55 and are disposed on the rear face 55A disposed opposite the front face 55B which attracts the armature 21. A first reed switch 70 is contained in the slot 67A adjacent to the bottom of the slot (see FIG. 4), while a second reed switch 71 is positioned in the slot 67B adjacent to the top of the slot (see FIG. 6). The reed switches 70-71 are installed on printed circuit boards and bonded to the rear face 55A of the electromagnet 55 so that the reed switches may be removed for realignment. The reed switches 70 and 71 detect the level of magnetic flux in the electromagnet 55 to determine whether or not the flux is at a predetermined level. The predetermined flux level is determined as the flux level within the slots 67A and 67B which exits when the armature 21 is in direct abuttment with and properly aligned with the electromagnetic 55. If the armature 21 is skewed with respect to the electromagnet 55, one or the other of the magnetic reed switches 70 or 71 will not close, indicating that the armature 21 is not properly aligned with the electromagnetic 55. If, for example, a sheet of paper, strip of tape or perhaps a strip of aluminum foil is placed between the armature 21 and the electromagnetic 55 so as to weaken the attraction between the armature and electromagnetic, the reed switches 70 and 71 will again pick up the reduction in the magnetic field and remain open.

Figure 7:
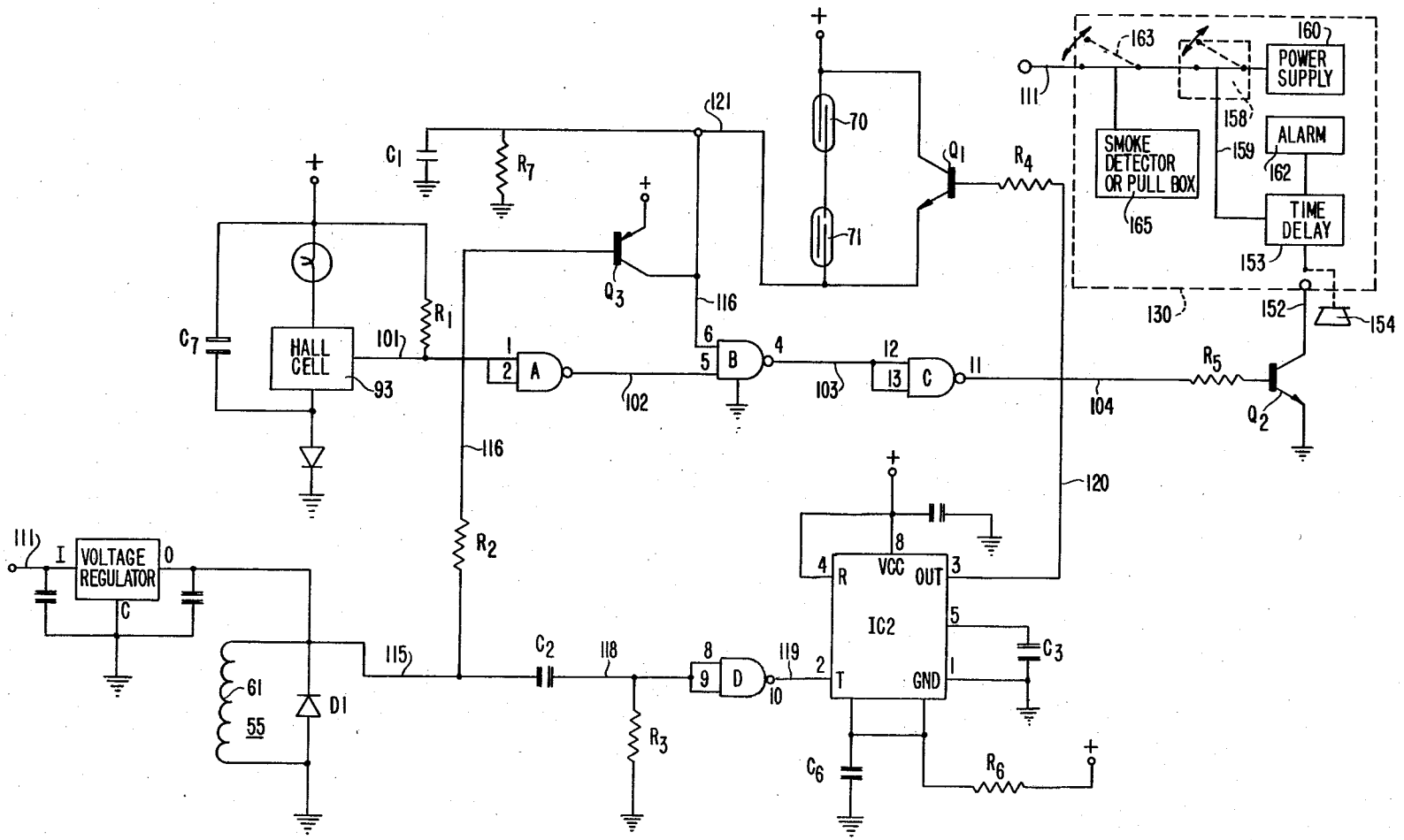
FIG. 7 is a schematic circuit diagram of a monitoring circuit used with the electromagnetic lock assembly of FIG. 1.

Adjacent to the electromagnetic 55 is an area 80 which accommodates the switch 35 and the printed circuit board 81 which accommodates the electrical circuitry set forth in FIG. 7. Positioned in the area 80 is a plunger (see FIGS. 3 and 5) 82 which is biased outwardly in the "X" direction by a coil spring 83. A rod 84 passes through the plunger 82 and is engaged in a slot 85 in a flange 86 so as to limit travel of the plunger to the length of the slot. The plunger 82 is received in a sleeve 87 mounted in a bracket 88 to which the printed circuit board 81 is secured by a pair of screws 90 which pass through a pair of insulating spacers 91. Secured to the flat rear end of the plunger 82 is a permanent magnetic 92, which is aligned with a Hall cell 93. When the door is opened, the spring 83 projects the plunger 82 so as to distance the permanent magnetic 92 from the Hall cell 93. Upon engaging the round end 94 of the plunger 82 with the block 95 on the armature 21, the permanent magnetic 92 is moved into closer proximity with the Hall cell 93 generating an electrical signal which indicates that the door 14 is closed with respect to the door jam 13.

When one presses on the door 14 and the electromagnet 55 is energized, the armature 21 will remain in tight abuttment with the face 55B of the electromagnet 55. However, pressure against the door 14 will cause the mounting plate 24 to move away from the armature 21 and the electromagnet 22. As is seen in FIGS. 3 and 5, attached to the mounting plate 24 is a block 95 which engages the end of pin 94. As the block 95 moves outwardly in the "X" direction away from the mounting plate 24, the plunger 82 also moves in the "X" direction under the bias of spring 83. This, of course, moves the magnet 92 out of proximity with the Hall cell 93, causing the Hall cell 93 to generate a signal to a control circuit 100 (see FIG. 7) indicating that an attempt is being made to open the door.

Referring now to FIG. 7, operation of the control circuit 100 follows the operation of the Hall cell 93. Upon closing the door 14, the block 95 engages the plunger 82 to move the magnet 92 into close proximity with the Hall cell 93. This causes a low to occur on line 101 which is applied to the inputs 1 and 2 of NAND gate A the results in a high on output line 102 which is applied to pin 5 of NAND gate B. Since there is already a high on pin 6 of NAND gate B, NAND gate B has a low output on line 103 which is applied to the pins 12 and 13 of NAND gate C. NAND gate C has a high output applied over line 104 which turns transistor $Q_2$ on. The collector of transistor $Q_2$ goes low and pulls to ground which causes the power supply to provide a high on line 111 so as to energize the coil 61 in the electromagnet 55 and build the magnetic field in the electromagnet. The magnetic field attracts the armature 21 and holds the armature 21 tight against the face 55B of the electromagnetic (see FIGS. 3–5).

If there is tape, a sheet of paper, or another shim placed on either the face 55B of the electromagnetic or on the face of the armature 21 so as to reduce the electromagnetic field, the reed switches 70 and 71, will not close. Moreover, if the armature 21 is skewed with respect to the face 55B of the electromagnet 55, then one of the reed switches 70 and 71 may close but the other will remain open. The condition of the Reed switches 70 and 71 is monitored by pin 6 of NAND gate B in conjunction with Q1 and Q3/IC2.

Upon applying current to line 111 to energize the coil 61 of the electromagnet 55, a high is applied on line 115. The high on line 115 is applied over line 116 to Q3 which turns off pnp transistor, Q3. Simultaneously, line 118 is momentarily pulsed high through capacitor C2 into pins 8 and 9 of NAND gate D creating a low pulse on line 119 to pin 2 of IC2. IC2 initiates a high from pin 3 to npn transistor Q1 over line 120, turning on Q1 and shunting the reed switches 70 and 71. This creates a high on line 121 and line 116 assuring a high on pin 6 of NAND gate B. The high on pin 6 of NAND gate B will remain for the predetermined timing set by C6 and R6, about two and one-half seconds, allowing the electromagnetic flux field to build up in electromagnet 55. When the two and one-half seconds expires, IC2 pin 3 goes low and a low goes out on line 120 to Q1 to turn Q1 off. When Q1 is turned off, the signal on pin 6 of NAND gate B is now controlled by the reed switches 70 and 71. If the reed switches 70 and 71 are both closed, a good magnetic bond between the electromagnet 55 and armature 21 is indicated and the reed switches are shorted out and a high remains on line 121, which high, when applied to NAND gate B along with the high on line 102, maintains the low on line 103, keeping transistor $Q_2$ on and maintaining power to the coil 61 of the electromagnetic 55. If the reed switches 70 and 71 are open, a low results on line 121 which results in a high on line 103 and a low on line 104 which turns transistor Q2 off, triggering the time delay circuit which initiates the fifteen to thirty second time delay cycle as is set forth by the reference.

If the door 14 is closed and an attempt is made to open the door while the electromagnet 55 is energized and the armature 21 is in place, then the block 95 moves away from the electromagnetic assembly, allowing the pin 82 to move the permanent magnetic 92 away from the Hall cell 93. The Hall cell then applies a high to line 101 which is inverted by the NAND gate A and results in a low on line 102. A low on line 102 results in a high on line 103 and a low on line 104 which turns transistor Q2 off. This starts the time delay circuitry 130 or, optionally, if one wishes to lock up the door without a time delay, sets off an alarm. The time delay circuitry 130 is connected to a power supply for the coils 61 of the electromagnet 55 through BR1 so as to interrupt power to the magnet 55 after a selected time interval which may be, perhaps, an interval of 15–30 seconds. The particular configuration that the time delay circuitry may assume is set forth in the related patents and patent application aforementioned in this discussion, which patents and patent application are incorporated herein by reference.

Considering the general time delay circuitry 130, more specifically, the output of the transistor $Q_2$ is connected via line 152 to the time delay chip 153 in accordance with a first embodiment of the invention, or connected directly to an indicator or alarm 154 via a dotted line 156 in accordance with a second embodiment of the invention. The time delay chip operates a switch 158 disposed in the power line 111 between the electromagnet power supply 160 and the coils 61 of the electromagnetic 55 so as to open the switch after a preselected time interval of perhaps 15 to 30 seconds has expired. The details of the time delay system are set forth most specifically in co-pending U.S. application Ser. No. 423,523, now U.S. Pat. No. 4,540,208. In accordance with principals set forth in the references incorporated by reference, specifically U.S. Pat. No. 4,540,208, the switch 158 is closed upon sensing that the door 14 is closed due to a high on line 104. However, when there is a low on line 104, the time delay chip initiates its count. As in the other patents listed under related patents, the time delay chip 153 is connected to an alarm 162, located at a control station and/or over the door 14, which is activated once the time delay starts its count. A switch 163 is provided in the line 111 to open the circuit between the electromagnet 55 and the power supply 160 if one wishes to deactivate the electromagnetic lock 20 or for some reason to by-pass the time delay chip 153. If necessary or desired, a smoke detector 165 or other emergency condition sensor may be connected to the line 111 to operate the switch 163 and to cut power from the power supply 160 to the electromagnet 55. Again, the appropriate circuitry for accomplishing this is also set forth in the aforementioned patents and more specifically set forth in co-pending U.S. patent application. Ser. No. 423,523, now U.S. Pat. No. 4,540,208.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a magnetic lock in combination with a door mounted in a door frame for locking the door with respect to the door frame:

an electomagnet mounted in the frame, the electromagnet having a core with oppositely facing front and rear surfaces, the core having a coil looped therein and a pair of laterally extending slots extending therein adjacent the rear surface thereof;

a power supply connected to the electromagnet for energizing the electromagnet;

an armature mounted on the door for engaging the electromagnet adjacent the front surface of the core when the door is shut;

sensing means disposed in the electromagnet for sensing if the armature is engaging the electromagnet, the sensing means including a pair of reed switches spaced laterally from one another; the reed switches being positioned in the slots with one reed switch adjacent to the bottom of the first slot and the other reed switch adjacent to the top of the second slot, wherein the reed switches in concert monitor magnet flux to detect whether the armature is skewed with respect to the electromagnet or whether the armature is directly in contact with the front surface of the electromagnet;

means for connecting the reed switches in series with one another;

circuit means including the reed switch connecting means, the circuit means including the reed switch monitoring means for detecting when at least one reed switch is open and when both reed switches are closed; and indicating means connected to the reed switch monitoring means for indicating the condition of the reed switches so as to indicate whether or not the armature is in engagement with the front surface of the electromagnet to securely lock the door.

2. The device of claim 1, further including timing means connected with the reed switch monitoring means, the timing means having a first input for starting a time interval and an output for monitoring the condition of the reed switches wherein the output for monitoring the condition of the reed switches is activated after a selected time interval, whereby monitoring of the reed switches occurs only after the door has been closed for the selected time interval.

3. The magnetic lock of claim 2, wherein a second switch having an output connected to a time delay and alarm is included, which second switch is separate from the reed switches and monitors the position of the door with respect to the door frame and the electromagnet rather than monitoring the magnetic flux of the electromagnet; the door lock further including a NAND gate having as one input the line connecting the reed switches and as the other input the output of the separate switch, wherein both the reed switch circuit and the second switch circuit must be properly activated to maintain controlled energization of the electromagnet and to maintain an indication that the door is securely locked.

4. In a magnetic lock in combination with a door mounted in a door frame, wherein the magnetic lock includes an electromagnet mounted on the door frame; and armature mounted on the door for engagement by the electromagnet and a power supply connected to the electromagnet for supplying current to the electromagnet to magnetically hold the armature, the improvement comprising:

a first mounting plate for mounting the electromagnet on the frame, the first mounting plate including holes therethrough receiving screws for securing the mounting plate to the door frame and having screw threaded holes at spaced locations therein;

a magnetically insulated housing for containing the electromagnet; the housing having means thereon for receiving at least two screws, which screws are threaded into the screw threaded holes in the first mounting plate;

means for securing the electromagnet in the housing;

a second mounting plate;

screw holes through the second mounting plate receiving screws for fixedly securing the second mounting plate to the door;

means for loosely securing the armature to the second mounting plate; wherein when the armature is magnetically held in contact with the electromagnet, the door may move relative to the door frame;

spring means disposed between the armature and the second mounting plate for urging the armature away from the second mounting plate and toward the electromagnetic when the door is closed;

a block mounted on the second mounting plate in spaced relation to the armature;

a plunger disposed on the first mounting plate in spaced relation to the electromagnet which plunger is in alignment with the block and is depressed by the block when the door is closed, and a switch operated by the plunger for providing a signal indicative of the position of the door, wherein when an attempt is made to open the door while the electromagnet is energized, the block moves away from the electromagnet while the armature remains in engagement with the electromagnet thereby allowing the plunger to operate the switch so as to provide the signal even when the door is locked by the electromagnet.

5. The magnetic lock of claim 4, wherein the second mounting plate includes a lower flange extending normally thereto, which lower flange covers the lower edge of the armature.

6. The magnetic lock of claim 4, wherein the first mounting plate has a hole therethrough which is in alignment with a hole through the housing, wherein leads from the electromagnet may be carried therethrough into the door frame.

7. The magnetic door lock of claim 4, further including means disposed between the power supply and the electromagnet for interrupting current to the electromagnet, the interrupting means including a time delay circuit connected to the switch means which time delay circuit interrupts the current after a selected time interval upon receiving the signal from the switch.

8. The magnetic door lock of claim 7, further including a pair of spaced, serially connected reed switches disposed adjacent to the electromagnet for detecting if the armature is properly engaged with the electromagnet by monitoring the magnetic flux thereof and indicating means connected to the reed switches for indicating if the magnetic flux drops below a selected level.

* * * * *